US006481389B2

(12) United States Patent
Suzuki et al.

(10) Patent No.: US 6,481,389 B2
(45) Date of Patent: Nov. 19, 2002

(54) PISTON OIL-COOLING DEVICE IN AN ENGINE

(75) Inventors: Nobuo Suzuki, Wako (JP); Mitsuharu Tanaka, Wako (JP); Hiroyuki Yoshida, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 10 days.

(21) Appl. No.: 09/756,202

(22) Filed: Jan. 9, 2001

(65) Prior Publication Data

US 2001/0037775 A1 Nov. 8, 2001

(30) Foreign Application Priority Data

Jan. 17, 2000 (JP) ..... 2000-010370

(51) Int. Cl.[7] ..... F01P 1/04
(52) U.S. Cl. ..... 123/41.35; 123/196 R
(58) Field of Search ..... 123/41.45, 35, 123/196 R, 257, 41.16, 41.17

(56) References Cited

U.S. PATENT DOCUMENTS 3,739,657 A * 6/1973 Patchen et al. ..... 74/587
3,785,459 A * 1/1974 Patchen ..... 184/6.5
5,482,380 A * 1/1996 Corrati et al. ..... 384/311
6,032,635 A * 3/2000 Moorman et al. ..... 123/196

FOREIGN PATENT DOCUMENTS

JP 437211 2/2002

* cited by examiner

*Primary Examiner*—Willis R. Wolfe
*Assistant Examiner*—Rebecca A Smith
(74) *Attorney, Agent, or Firm*—Arent Fox Kintner Plotkin & Kahn, PLLC

(57) ABSTRACT

A piston is reliably cooled from its backside by using an oil for lubricating portions around a crank pin of a crankshaft. An engine including a crankshaft is provided with lubricating oil bores to supply an oil from journals of the crankshaft to an outer peripheral surface of a crank pin. A larger end of the connecting rod is provided with a pair of opposed axial oil grooves in its outer peripheral surface, and with an annular oil passage connected to the axial groove in its side thrust face. A pair of cooling oil injection grooves each have one end connected to the annular oil passage and the other end directed to a piston while they are provided proximate to each other.

5 Claims, 9 Drawing Sheets

PISTON OIL-COOLING DEVICE IN AN ENGINE

BACKGROUND OF THE INVENTION

1. Field of the Invention

The present invention relates to a piston oil-cooling device in an engine in which a crankcase that supports journals of a crankshaft is provided with lubricating oil passages to supply oil to outer peripheral surfaces of the journals. The crankshaft is provided with lubricating oil bores to supply the oil from the journals to an outer peripheral surface of a crank pin and a piston is cooled from its backside by using the oil to lubricate portions around the crank pin.

2. Description of the Related Art

Conventional piston oil-cooling devices in engines typically include a piston oil-cooling device in a horizontal engine with a crankshaft disposed horizontally. An oil dipper is formed at a larger end of a connecting rod so that oil in an oil pan at a bottom of a crankcase is scattered by the oil dipper due to the rotation of the crankshaft. The scattered oil is permitted to reach a backside of a piston to cool the piston. The conventional piston oil-cooling devices also typically include another piston oil-cooling device having an oil injection bore provided in the larger end of the connecting rod to communicate with a lubricating oil bore in the crankshaft so that a piston is cooled from its backside by the oil injected from the oil injection bore. See Japanese Utility Model Publication No.4-37211.

Unfortunately, the first-mentioned conventional device is not applicable to a vertical engine with a crankshaft that is disposed vertically. Also, the second-mentioned conventional device is applicable to either horizontal and vertical engines, but suffers from a drawback in that much labor is needed to make the oil injection bore in the larger end of the connecting rod by drilling, which results in an increase in cost, as well as manufacturing time and effort.

SUMMARY OF THE INVENTION

Accordingly, it is an object of the present invention to provide a piston oil-cooling device applicable to either horizontal and vertical engines, wherein a piston can be reliably cooled from its backside by using an oil to lubricate portions of a crank pin of a crankshaft, wherein the oil injection bore can easily be made, which reduces manufacturing time and effort, thereby reducing cost.

To achieve the above object, according to a first aspect and feature of the present invention, there is provided a piston oil-cooling device in an engine in which a crankcase that supports journals of a crankshaft is provided with lubricating oil passages to supply oil from an oil pump to outer peripheral surfaces of the journals. The crankshaft is provided with lubricating oil bores to supply the oil from the journals to an outer peripheral surface of a crank pin. A larger end of a connecting rod connected to the crank pin is provided in an inner peripheral surface with a pair of opposed axial oil grooves. The larger end is also provided in a side thrust face with an annular oil passage connected to the axial groove and a cooling oil injection groove. The cooling oil injection groove is connected at one end thereof to the annular oil passage while the other end is directed to a backside of a piston which is connected to a smaller end of the connecting rod.

With the first feature, when the lubricating oil bores in the crankshaft are aligned with the axial oil grooves in the larger end of the connecting rod, the oil in the lubricating oil bores is injected from the cooling oil injection groove via the axial oil grooves and the annular oil passage in the larger end toward the backside of the piston to effectively cool the piston. Therefore, the force of the injected oil is always strong and reaches the piston properly, thereby effectively cooling the piston. Thus, the piston oil-cooling device is applicable to either vertical and horizontal engines. Moreover, the cooling oil injection groove, the annular oil passage, and the axial oil grooves can be manufactured simultaneously with the formation of the connecting rod, thereby reducing manufacturing time and effort, as well as cost.

According to a second aspect and feature of the present invention, in addition to the first feature, a pair of the cooling oil injection grooves are disposed in proximity to the pair of axial oil grooves on the same side thrust face, respectively.

With the second feature, the pair of cooling oil injection grooves are in proximity to the pair of axial oil grooves, respectively. Therefore, when the lubricating oil bores in the crankshaft are aligned with each of the axial oil grooves, the oil is injected, having a particularly strong force, from the cooling injection groove closer to the axial groove. Such a situation occurs once per rotation of the crankshaft and hence, the oil cooling of the piston can be carried out more effectively.

According to a third aspect and feature of the present invention, in addition to the first or second feature, when the engine is of a vertical type with a crankshaft disposed vertically, the cooling oil injection groove is provided in a lower side thrust face of the larger end.

With the third feature, the opposed side thrust faces of the larger end and the crankshaft are brought into close contact by the weight of the connecting rod. Therefore, leakage of the cooling oil from the cooling oil injection groove in the larger end of the connecting rod between both of the side thrust faces is eliminated to maintain the injection force of the oil from the cooling oil injection groove. Also, oil injected from the cooling oil injection groove is permitted to easily reach the piston without being obstructed by the connecting rod, thereby further effectively achieving the oil cooling of the piston.

According to a fourth aspect and feature of the present invention, in addition to the first or second feature, a side thrust face of the crankshaft opposed to the side thrust face of the larger end is formed to cover the entire open surface of the cooling oil injection groove.

With the fourth feature, the open surface of the cooling oil injection groove in the larger end of the connecting rod is closed by the side thrust face of the crankshaft. Therefore, it is possible to prevent a wasteful flowing-out of the cooling oil from the open surface of the cooling oil injection groove and to maintain the injection force of the oil from the cooling oil injection groove, thereby more effectively achieving the oil cooling of the piston.

According to a fifth aspect and feature of the present invention, in addition to the first or second feature, the larger end is comprised of a semi-cylindrical larger end body integrally formed at a rod portion, and a semi-cylindrical cap coupled to the larger end body, and the pair of axial oil grooves are provided at a boundary between the larger end body and the cap.

With the fifth feature, it is possible to avoid the damage to the outer peripheral surface of the crank pin by the boundary between the larger end body and the cap by using the axial oil grooves.

The above and other objects, features and advantages of the present invention will become apparent from the following description taken in conjunction with the accompanying drawings.

DETAILED DESCRIPTION OF THE PREFERRED EMBODIMENT

Figure 1:
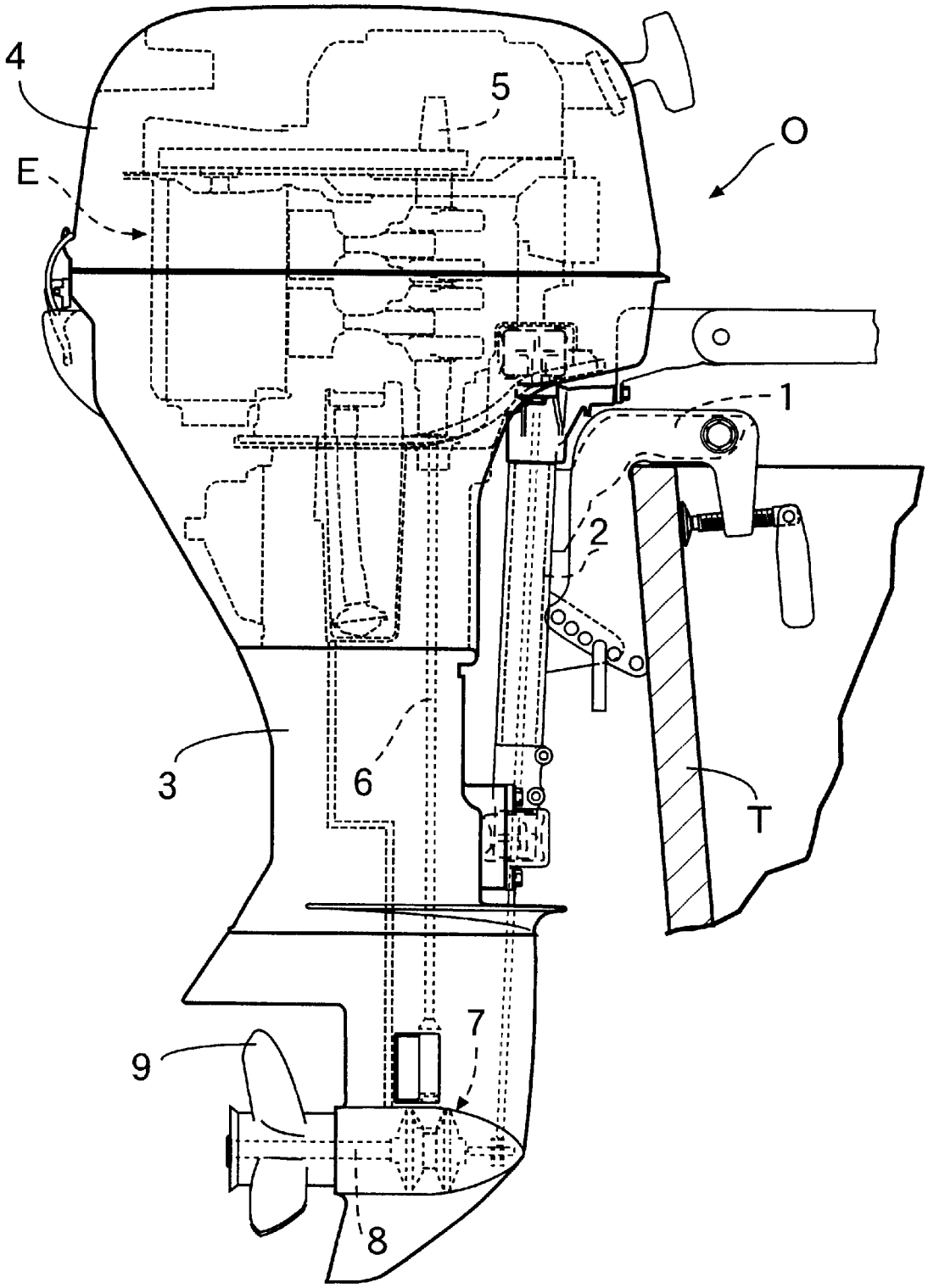
FIG. 1 is a side view of an outboard engine system including an engine to which the present invention is applied.

Referring to FIG. 1, an outboard engine system O includes a stern bracket 1 clamped at a transom T of a hull. A vertically extending casing 3 that swings in a lateral direction relative to the hull is connected to the stern bracket 1 through a swivel shaft 2. An engine E is mounted at an upper portion of the casing 3 and an engine cover 4 is coupled to the casing 3 to cover the engine E. Power output from a crankshaft 5 of the engine E is transmitted to a propeller shaft 8 supported at a lower portion of the casing 3 through a drive shaft 6 disposed in the casing 3 and a bevel gear transmitting device 7 capable of switching-over the forward and rearward movements from each other, thereby driving a propeller 9 mounted at a rear end of the propeller shaft 8.

Figure 2:
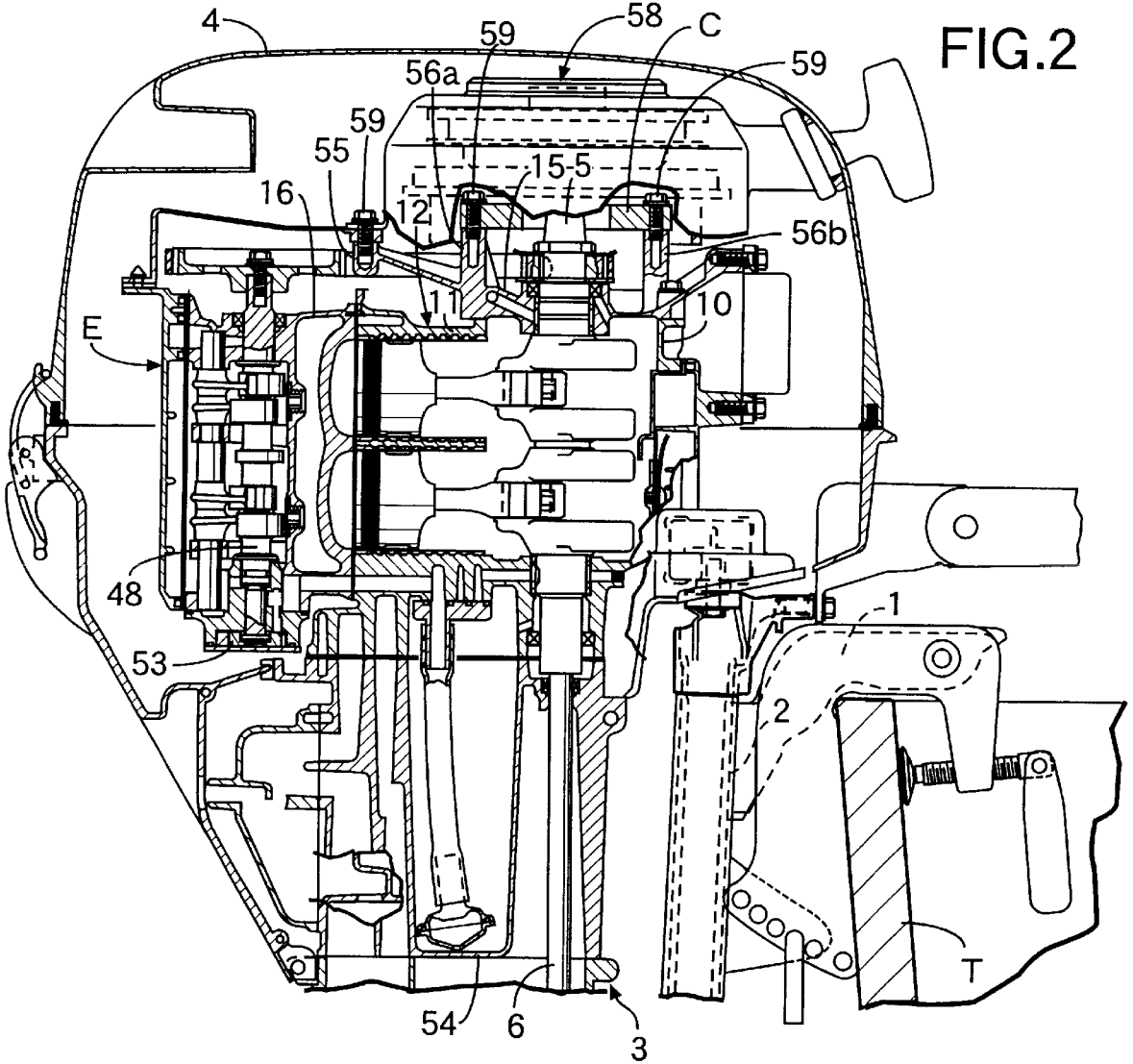
FIG. 2 is a vertical sectional view of the engine.
Figure 3:
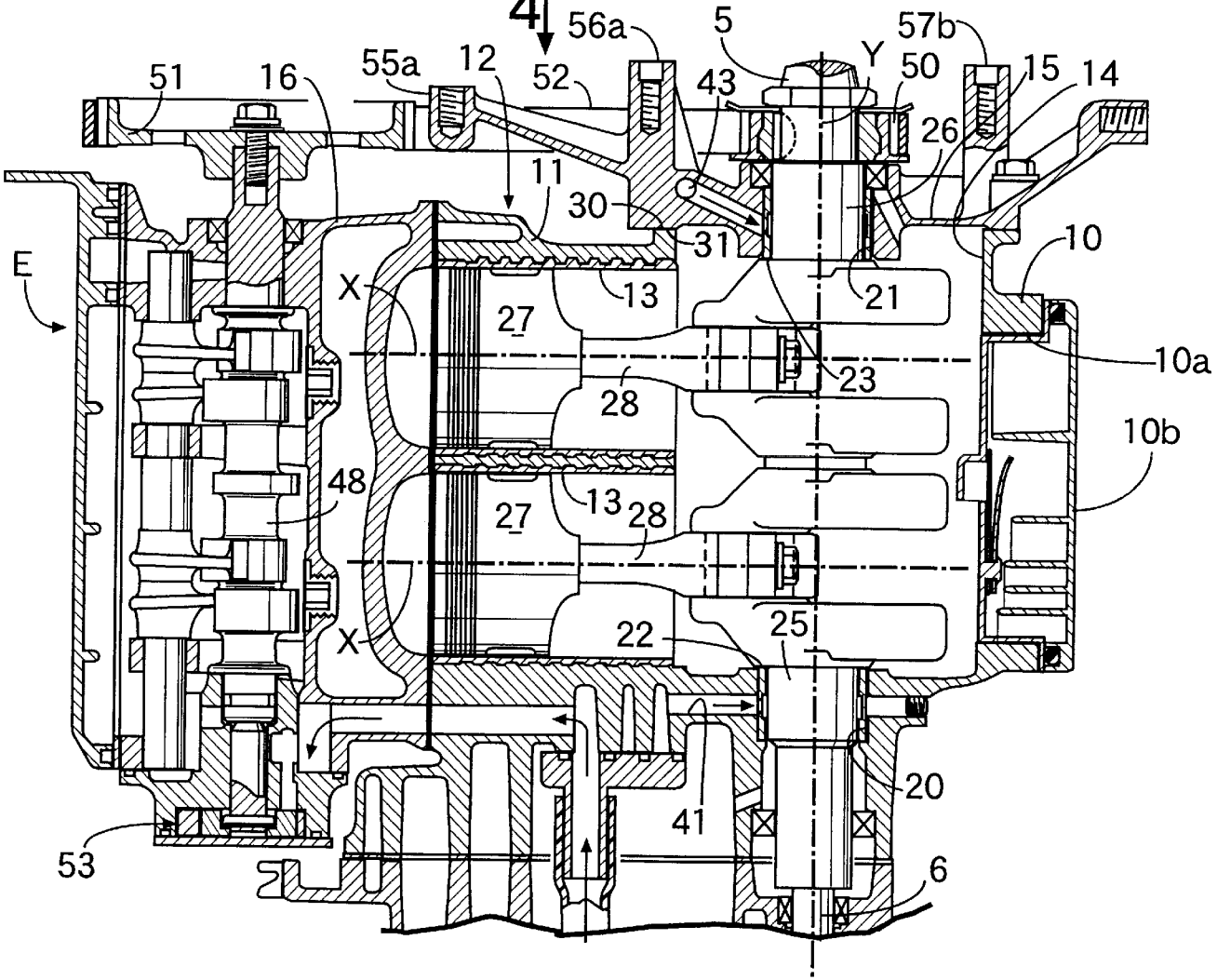
FIG. 3 is an enlarged view of a portion shown in FIG. 2.

Referring to FIGS. 2 and 3, the engine E is mounted in the casing 3 in an attitude in which the crankshaft 5 has been turned vertically and a cylinder block 11 has been turned rearwards of the hull. The engine E includes an engine block 12 with a crankcase 10 and the cylinder block 11 formed integrally with each other. Two upper and lower cylinder bores 13, 13 having axes turned horizontally are provided in the cylinder block 11.

The crankcase 10 has a closed bottom wall and an upper wall having an opening 14 for assembling the crankshaft 5. A case cover 15 is coupled to the crankcase 10 to cover the opening 14.

First and second bearing bores 20 and 21 are provided in the bottom wall of the crankcase 10 and the case cover 15. A lower first journal 25 and an upper second journal 26 of the crankshaft 5 are carried by first and second bearing bushes 22 and 23 which are fitted in the bearing bores 20 and 21, respectively. Connecting rods 28, 28 are connected at their smaller ends 28*a* (FIG. 8) to a pair of upper and lower pistons 27, 27 reciprocally movable in the cylinder bores 13, 13, and at their larger ends 28*b* (FIG. 7) to a pair of upper and lower crank pins 5*a*, 5*a* of the crankshaft 5, respectively.

A working bore 10*a* is provided in a sidewall of the crankcase 10 opposite to the cylinder bores 13, 13 for assembling the connecting rods 28, 28. The working bore 10*a* is closed by a side lid 10*b*.

The structure of coupling the crankcase 10 and the case cover 15 will be described with reference to FIGS. 4 to 6.

The crankcase 10 and the case cover 15 are each provided with a pair of positioning bores 32 and 33; 34 and 35, respectively, which open into a joint face 30, 31 thereof. The positioning bores 32, 33, 34 and 35 are disposed at locations closer to the cylinder block 11 than the second bearing bush 23 and spaced equidistantly on opposite sides of a plane P including an axis Y of the crankshaft 5 and axes X of the cylinder bores 13, 13. Halves of a pair of knock pins 36 and 37 are press-fit into the positioning bores 32 and 33 in the crankcase 10, and the positioning bores 34 and 35 in the case cover 15 are fit over the other halves of the knock pins 36 and 37, respectively. Thus, the joint positions of the crankcase 10 and the case cover 15 are defined to coaxially arrange the first and second bearing bushes 22 and 23.

A plurality of threaded bores 38 are provided in the crankcase 10 and open into the joint face 30 to surround the opening 14. A corresponding number of bolt-insertion bores 39 are provided in the case cover 15. Thus, the crankcase 10 and the case cover 15 are coupled to each other by threadedly fitting bolts 40 through the bolt-insertion bores 39 into the threaded bores 38 and then tightening the bolts 40. A liquid packing is then applied to at least one of the joint faces 30 and 31 of the crankcase 10 and the case cover 15.

Thus, when an explosion load is applied from the pistons 27, 27 to the crankshaft 5 through the connecting rods 28, 28 during an explosion stroke of the engine E, a shearing load is applied to the joint faces 30 and 31 of the crankcase 10 and the case cover 15. However, a shearing stress generated on the knock pins 36 and 37 and a frictional force applied to the joint faces 30 and 31 by the plurality of bolts 40 resist the shearing load.

Furthermore, because the pair of knock pins 36 and 37 are positioned closer to the cylinder block 11 than the second bearing bushes 23 , when the explosion load is applied from the crankshaft 5 to the case cover 15, a tensile stress is generated in a wide area between the second bearing bush 23 and the pair of knock pins 36 and 37. Therefore, because the case cover 15 is strongly resistant to the tensile stress, the case cover 15 exhibits a high rigidity in cooperation with the dispersion of the tensile stress.

In this way, the pair of knock pins 36 and 37 define the position for coupling of the crankcase 10 and the case cover 15 to each other, but also contribute to increasing the rigidity of the case cover 15. Therefore, it is possible to increase the supporting strength of the crankshaft 5, reduce the weight of the case cover 15, and decrease the number of bolts 40 used.

In addition, the knock pins 36 and 37 are positioned equidistantly from the plane P including the axis of the crankshaft 5 and the axes X of the cylinder bores 13, 13. Therefore, it is possible to effectively provide the equalization of the shearing load applied to both of the knock pins 36 and 37 and disperse the tensile stress generated on the case cover 15, thereby enhancing the durability of the knock pins 36 and 37 and the case cover 15.

The bearing bore 20 for mounting of the first bearing bush 22 to support the first journal 25 of the crankshaft 5 is provided in the engine block 12, and the bearing bore 21 for mounting of the bearing bush 23 to support the second journal 26 of the crankshaft 5 is provided in the case cover 15. Therefore, it is not necessary to machine the two members while in a coupled state to form the bearing bores 20 and 21 as is common in conventional engines. Thus, a step of coupling the two members to each other and a step of separating them from each other is not required, which reduces the manufacturing cost, but also permits replacement of either the engine block 12 and the case cover 15, leading to an enhanced interchangeability of parts.

Moreover, the supplying of a lubricating oil to the second journal 26 of the crankshaft 5 is conducted from the oil pump 53 through the oil passages 42 and 43 provided in the engine block 12 and the case cover 15. Therefore, it is not necessary to define an oil passage for lubricating the second journal 26 in the crankshaft 5, which also simplifies the structure of the oil passage in the crankshaft 5.

Figure 4:
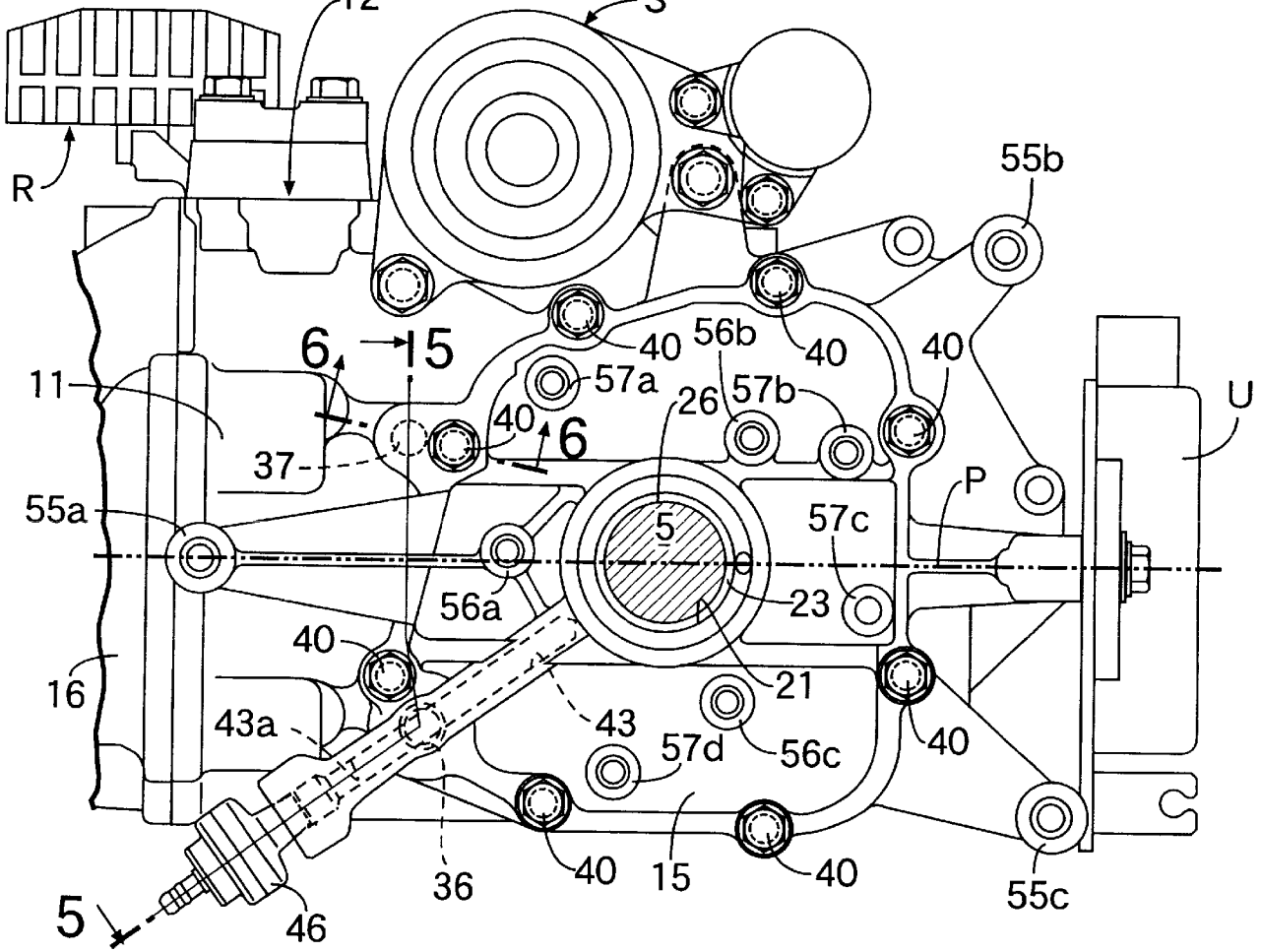
FIG. 4 is a view taken in the direction of an arrow 4 in FIG. 3.

In FIG. 4, reference character U designates an igniting CDI device mounted on the side lid 10*b* and a boss formed on the case cover 15. Reference character S is a starting motor, and R is a regulator rectifier for a power supply, both of which are mounted on an upper wall of the engine block 12.

Referring again to FIG. 3, a valve operating camshaft 48 is disposed parallel relative to the crankshaft 5 and is carried in the cylinder head 16 coupled to a rear end of the cylinder block 11. Driving and driven pulleys 50 and 51 are secured to the crankshaft 5 and the camshaft 48 above the cylinder head 16 and the case cover 15, respectively, and a timing belt 52 is reeved around the driving and driven pulleys 50 and 51, so that the crankshaft 5 drives the camshaft 48 at a reduction ratio of ½.

The oil pump 53 is mounted at a lower rear portion of the cylinder block 11 and driven by the camshaft 48. The oil pump 53 pumps an oil from an oil case 54 (see FIG. 2) coupled to a lower portion of the engine block 12 and accommodated in the casing 3 to supply the oil to a first lubricating oil passage 41 defined through a lower wall of the cylinder block 11 and a second lubricating oil passage 42 defined through one sidewall of the cylinder block 11 and extends upwards.

Figure 7:
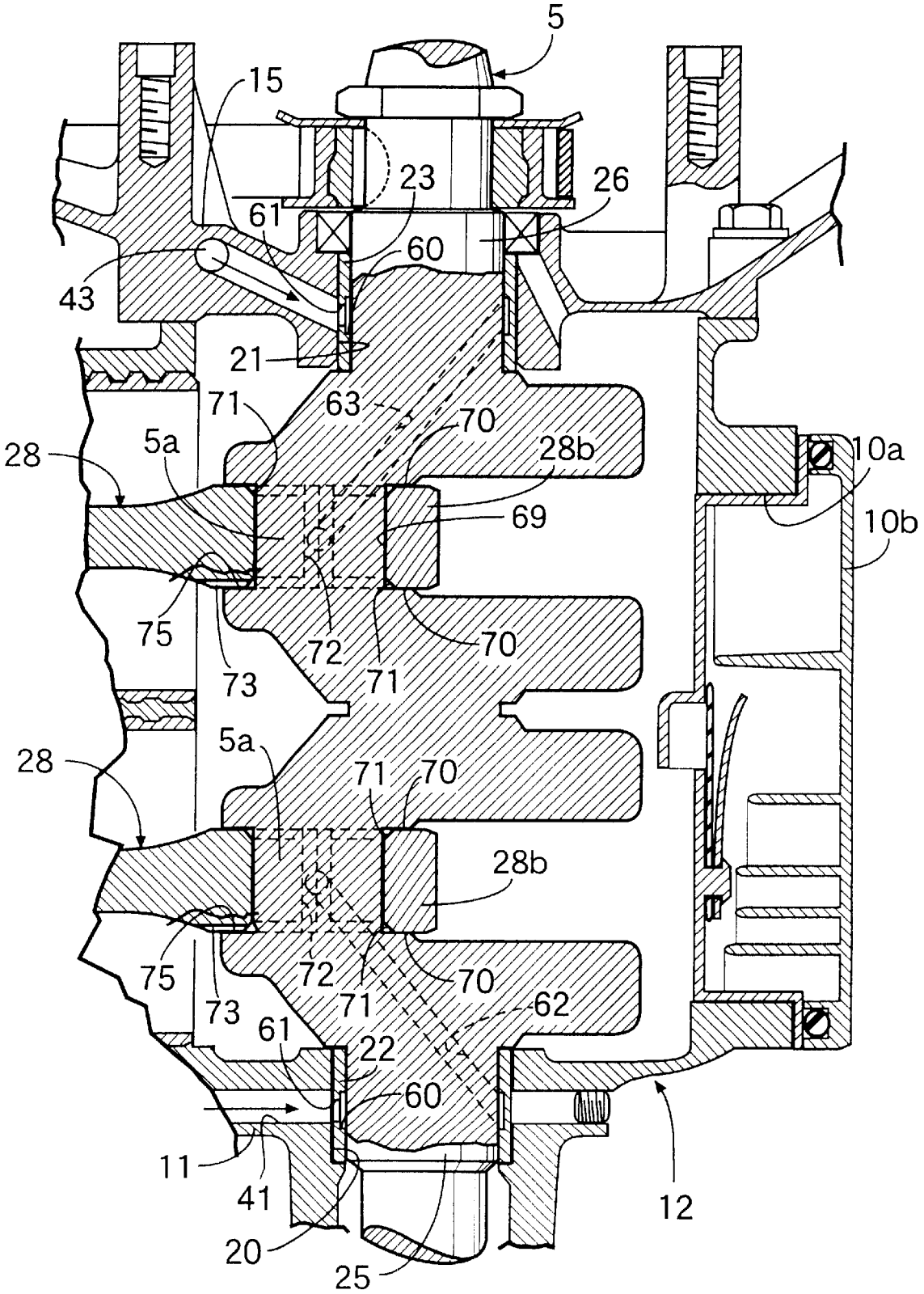
FIG. 7 is an enlarged vertical sectional view of a crankshaft shown in FIG. 3.

As shown in FIG. 7, each of the first and second bearing bushes 22 and 23 is provided with an annular lubricating groove 60 that opens into an inner surface thereof, and a through-bore 61 that permits the lubricating groove 60 to communicate with an outer peripheral surface of the bearing bushes 22 and 23. The first lubricating oil passage 41 communicates with the through-bore 61 in the first bearing bush 22, and the second lubricating oil passage 42 is connected to a third lubricating oil passage 43 defined in the case cover 15 through a hole 36*a* in the hollow knock pin 36. The third lubricating oil passage 43 communicates with the through-bore 61 in the second bearing bush 23.

Figure 5:
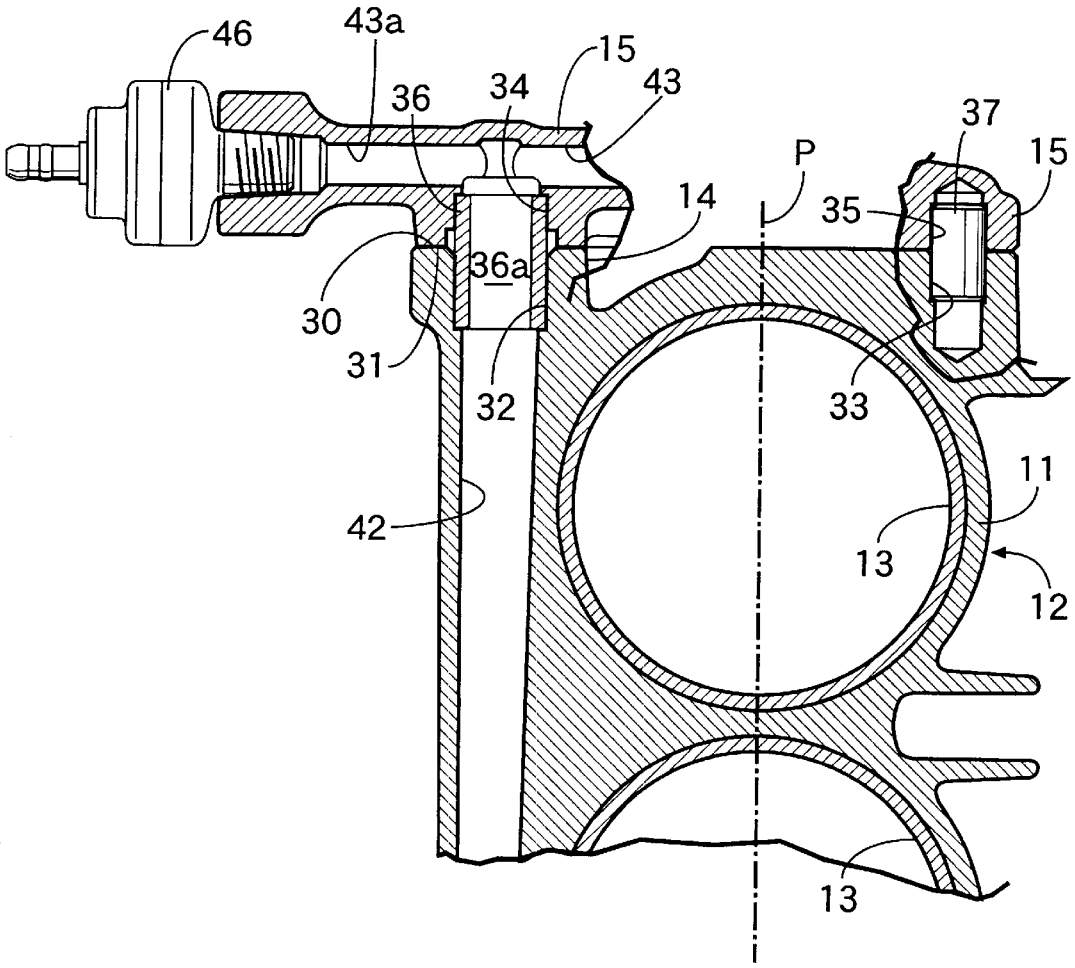
FIG. 5 is a sectional view taken along a section line 5—5 in FIG. 4.
Figure 6:
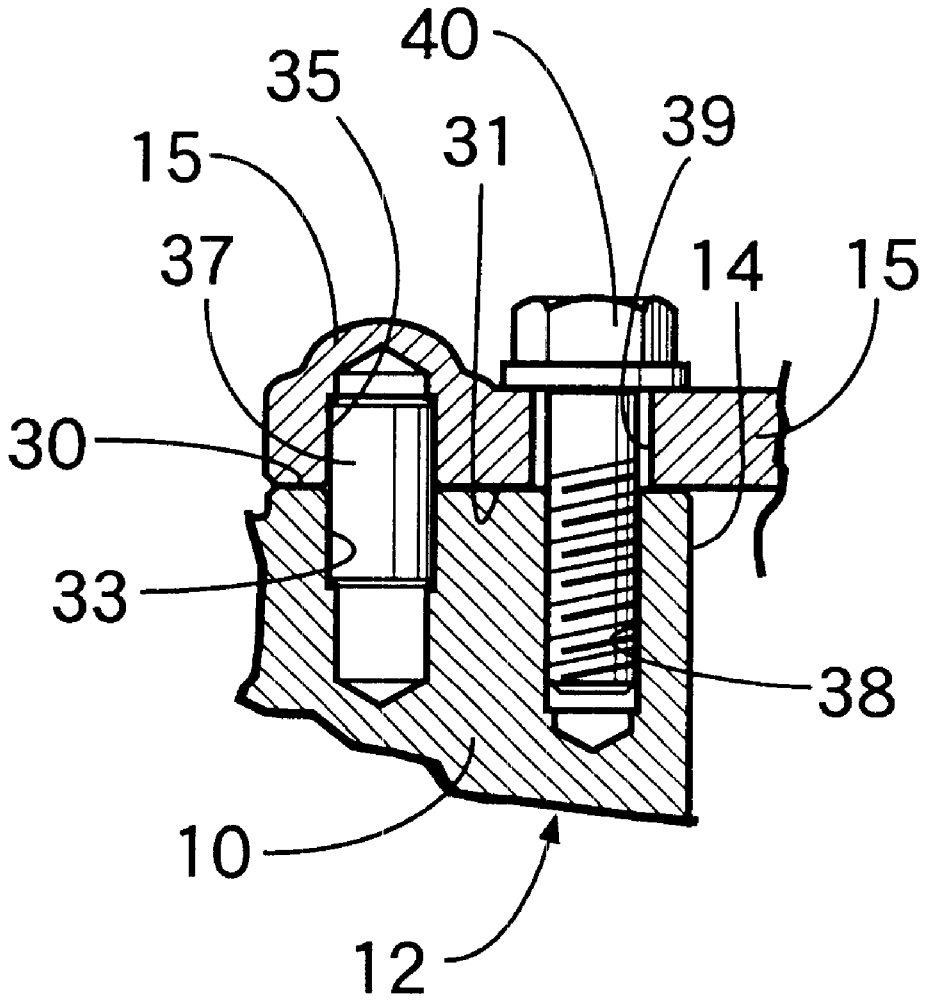
FIG. 6 is a sectional view taken along a section line 6—6 in FIG. 4.

A working bore 43*a* of the third lubricating oil passage 43 opens into one side of the case cover 15, as shown in FIGS. 4 and 5. A hydraulic pressure sensor 46 is threadedly mounted in the working bore 43*a* to detect a pressure discharged from an oil pump 53 through the third lubricating oil passage 43. With such a structure, it is not necessary to especially provide an exclusive bore for mounting the hydraulic pressure sensor 46 in the case cover 15, thereby leading to a reduction in cost. In this case, the disposition of the hydraulic pressure sensor 46, with a tip end turned laterally and rearwards of the outboard engine system O, decreases the overhanging of the hydraulic pressure sensor 46 in an outward direction of the engine block 12, which avoids increasing the size of the engine cover 4.

Figure 8:
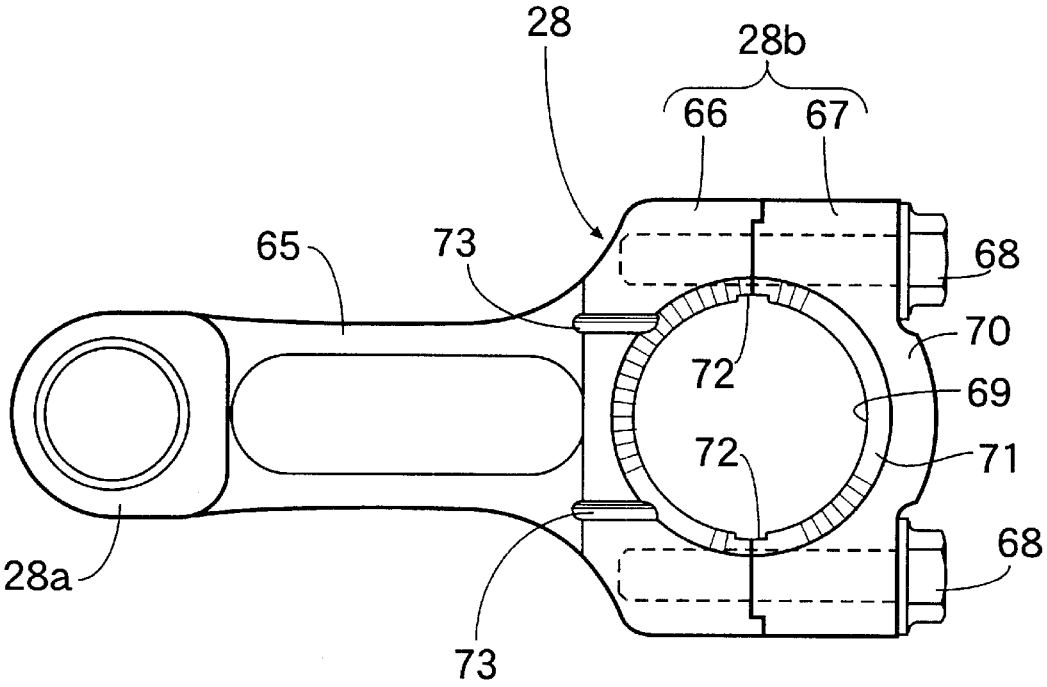
FIG. 8 is a plan view of one of connecting rods shown in FIG. 7.

As shown in FIG. 8, the larger end 28*b* of each of the connecting rods 28 includes a semi-cylindrical larger end body 66 integrally formed at a rod portion 28*a* and a semi-cylindrical larger end cap 67 coupled to the semi-cylindrical larger end body 66 by bolts 68. A crank pin hole 69 that supports the corresponding crank pin 5*a* is defined within inner peripheral surfaces of the semi-cylindrical larger end body 66 and the semi-cylindrical larger end cap 67. Annular oil passages 71, 71 defined in upper and lower side thrust faces 70, 70 conically extend down into the crank pin hole 69.

Axial oil grooves 72, 72 are provided within an inner peripheral surface of the crank pin hole 69 and connect the oil passages 71, 71 to each other. Each axial oil groove 72, 72 has a U-shape in section with a large width so that it passes through a boundary between the larger end body 66 and the larger end cap 67. In this manner, a large path area of each axial oil groove 72 can be ensured even though it is a narrow portion between the inner peripheral surface of the crank pin hole 69 and the bolt 68. Each axial oil groove 72, 72 is used as a recess to prevent the boundary between the larger end body 66 and the larger end cap 67 from coming into contact with the outer peripheral surface of the crank pin 5*a*.

The axial oil grooves 72, 72 in the lower connecting rod 28 communicate with the first lubricating oil bore 62 at predetermined different angles of rotation of the crankshaft 5, respectively. The axial oil grooves 72, 72 in the upper connecting rod 28 align and communicate with the second lubricating oil bore 63 at predetermined different angles of rotation of the crankshaft 5, respectively.

The lower side thrust face 70 of the larger end 28*b* of each connecting rod 28 is provided with a pair of cooling oil injection grooves 73, 73 connected at one end thereof to the annular oil passage 71 and with the other end directed toward a backside of the corresponding piston 27. The cooling oil injection grooves 73, 73 are disposed in proximity to the pair of axial oil grooves 72, 72, respectively. The cooling oil injection grooves 73, 73, the annular oil passages 71, 71 and the axial oil grooves 72, 72 are manufactured upon the formation of the connecting rod 28 by either one of a casting process, a forging process, or a sintering process. Hence, a special process or machine is not required to produce them.

The side thrust face 75 of the crankshaft 5 opposed to the lower side thrust face 70 of the larger end 28*b* of each connecting rod 28 is formed to bulge toward the smaller end 28*a*, so that it covers the open surfaces of the cooling oil injection groove 73 substantially over the entire length.

As shown in FIGS. 2 to 4, a large number of mounting bosses are provided on and project from the outer surface of the case cover 15. A recoiled starting device 58 is bolted to mounting bosses, 55*a* to 55*c* disposed at apexes of a triangle at locations farthest from the crankshaft 5. In the present embodiment, a measure is taken so that the parts or components can be used commonly in any outboard engine system having a specification of 6 volts or 12 volts in power-generating and charging systems.

For example, in the specification of 12 volts, a circular annular multi-pole power-generating coil C (see FIG. 2) is secured to bosses 56*a* to 56*c* disposed at apexes of a triangle at locations closest to the crankshaft 5. In the specification of 6 volts, a semicircular igniting power coil is bolted at its opposite ends to bosses 57*a* and 57*b* disposed at intermediate locations, and a semicircular charging coil is bolted at its opposite ends to bosses 57*c* and 57*d*.

The operation of the engine E will be described below.

When the oil pump 53 driven by the camshaft 48 supplies oil to the first and second lubricating oil passages 41 and 42 during operation of the engine E, the oil supplied to the first lubricating oil passage 41 is permitted to flow through the through-bore 61 in the first bearing bush 22 into the lubricating groove 60 in the inner periphery to lubricate the first journal 25 of the crankshaft 5. The oil supplied to the second lubricating oil passage 42 is permitted to flow via the third lubricating oil passage 43 through the through-bore 61 in the second bearing bush 23 into the lubricating groove 60 in the inner periphery to lubricate the second journal 26 of the crankshaft 5.

Figure 9A:
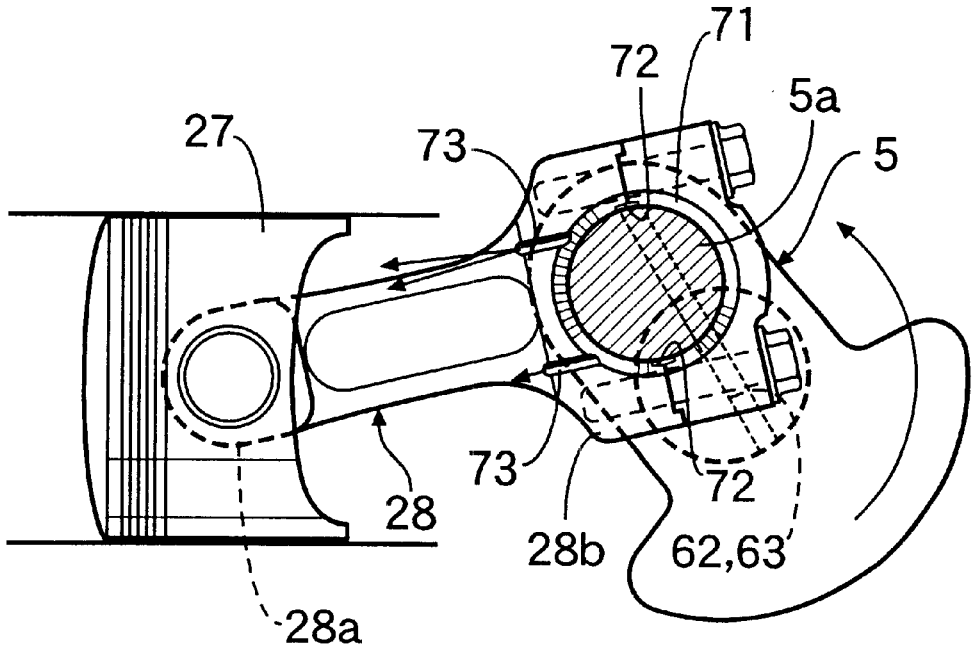
FIGS. 9A and 9B illustrate operation of the invention.

A portion of the oil supplied to each of the lubricating grooves 60, 60 in the first and second bearing bushes 22 and 23 as described above flows toward each of the first and second lubricating oil bores 62 and 63. When the first and second lubricating oil bores 62 and 63 are aligned with one of the axial oil grooves 72 in the larger end 28*b* of the corresponding connecting rod at the predetermined angles of rotation of the crankshaft 5 in the above manner, as shown in FIG. 9A, the oil in each of the first and second lubricating oil bores 62 and 63 is passed from the one axial oil groove 62 into the upper and lower annular oil passages 71, 71 in the larger end 28*b* to lubricate the crank pin hole 69 and the upper end lower side thrust faces 70, 70 of the larger end 28*b*, as well as the crank pin 5*a*.

A portion of the oil flowing into the annular oil passage 71, 71 is permitted to flow through the annular oil passages 71 into the pair of cooling oil injection grooves 73, 73 in the larger end 28*b*, and is injected therefrom toward the backside of the piston 27. Particularly, the force of the oil is less abated in the cooling oil injection groove 73, which is closer to the corresponding lubricating oil bore 62 or 63. Therefore, a relatively large amount of oil is injected forcefully from the cooling oil injection groove 73 and thus, reliably reaches the backside of the corresponding piston 27, thereby effectively cooling the piston 27.

Figure 9B:
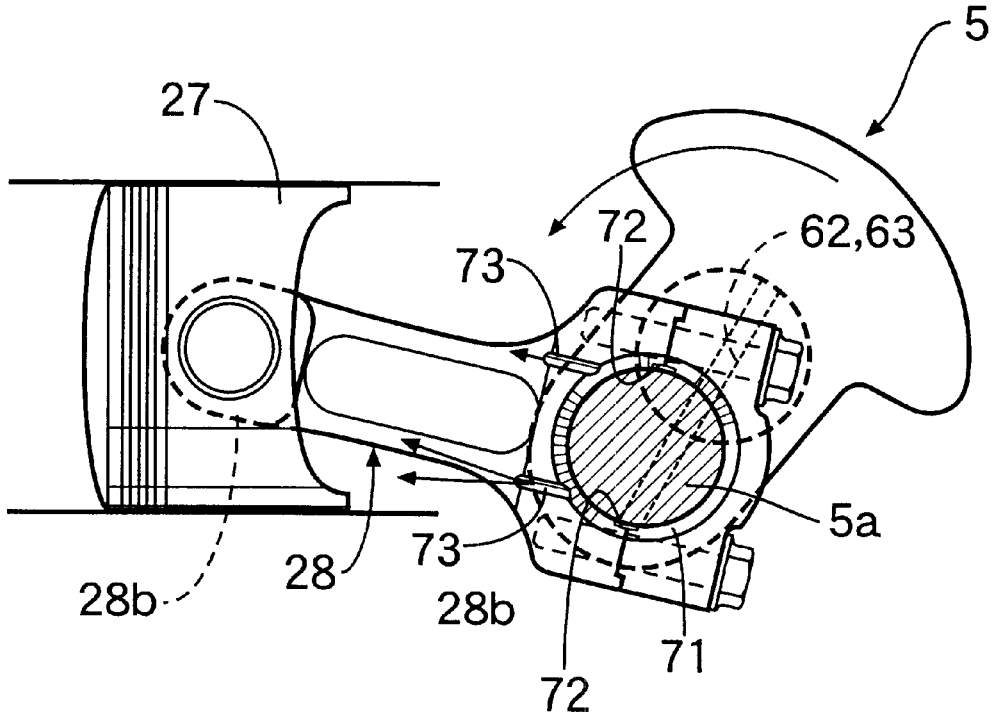

When the first and second lubricating oil bores 62 and 63 are aligned with the axial oil groove 72 in the larger end 28*b* of the corresponding connecting rod 28 at the different predetermined angles of rotation of the crankshaft 5, as shown in FIG. 9B, the crank pin hole 69 and the upper and lower side thrust faces 70, 70 of the larger end 28*b* are lubricated by the oil passing from the first and second lubricating oil bores 62 and 63 via the other axial oil groove 72 to the annular oil grooves 71, 71 in the same manner as that described above. Thus, a relatively large amount of oil is injected forcefully, particularly from the other cooling oil injection groove 73 closer to the other axial oil groove 72, thereby effectively cooling the corresponding piston 27 from the backside.

Notwithstanding that the axial oil grooves 72, 72 formed into the U-shape in section with the large width in the larger end 28*b* of each connecting rod 28 are narrow portions between the inner peripheral surface of the crank pin hole 69 and the bolt 68, a large path area is provided therein, and the duration of communication between the first and second lubricating oil bores 62 and 63 and the axial oil grooves 72, 72 in each connecting rod 28 is thereby prolonged. Therefore, a large amount of oil is supplied to the lubricating oil bores 62 and 63, thereby enhancing the oil-cooling effect for the piston 27.

In the vertical engine as described above, the cooling oil injection grooves 73, 73 in each of the connecting rods 28 are provided in the lower side thrust face 70 of the larger end 28*b* of the connecting rod 28. Thus, the opposed side thrust faces 70 and 75 of the larger end 28*b* and the crankshaft 5 are in closed contact with each other under the weight of the connecting rod 28. Therefore, it is possible to inhibit the leakage of the cooling oil from the cooling oil injection grooves 73, 73 in the connecting rod 28 between both side thrust faces 70 and 75 to maintain the force of the oil injected from the cooling oil injection grooves 73, 73. Moreover, it is possible to ensure that the oil injected from the cooling oil injection grooves 73, 73 easily reaches the corresponding piston 27 without being obstructed by the connecting rod 28. As a result, the piston 27 can effectively be further cooled.

The side thrust face 75 of the crankshaft 5 opposed to the side thrust face 70 of the larger end 28*b* of each connecting rod 28 is formed to cover the entire open surfaces of the cooling oil injection grooves 73, 73. Thus, the open surfaces of the cooling oil injection grooves 73, 73 in the larger end 28*b* of the connecting rod 28 are closed by the side thrust faces 75 of the crankshaft 5. Thus, wasteful leakage of the cooling oil from the open surfaces of the cooling oil injection grooves 73, 73 is prevented to maintain the force of the oil injected from the cooling oil injection grooves 73, 73, thereby more effectively cooling the piston 27.

Further, the axial oil grooves 72, 72 in each of the connecting rods 28 are provided in the boundary between the larger end body 66 and the cap 67 constituting the larger end 28*b*. Accordingly, damage to the outer peripheral surfaces of the crank pins 5*a*, 5*a* by the boundary between the larger end body 66 and the cap 67 is avoided.

Although the preferred embodiment of the present invention has been described above in detail, it will be understood that the present invention is not limited to the above-described embodiment, and various modifications in design may be made without departing from the subject matter of the invention. For example, the engine E may be formed into a horizontal type with its crankshaft disposed horizontally, or into a single-cylinder type.

What is claimed is:

1. A piston oil-cooling device in an engine comprises:

a crankshaft;

a crankcase that supports journals of said crankshaft, said crankcase is provided with lubricating oil passages to supply oil from an oil pump to outer peripheral surfaces of said journals, wherein said crankshaft is provided with lubricating oil bores to supply the oil from said journals to an outer peripheral surface of a crank pin;

a connecting rod including a larger end connected to said crank pin, said larger end being provided with a pair of opposed axial oil grooves in an inner peripheral surface of the larger end and an annular oil passage formed in a side thrust face of the larger end and connected to said axial oil grooves; and a cooling oil injection groove formed in said side thrust face and having one end thereof connected to said annular oil passage and the other end directed to a backside of a piston which is connected to a smaller end of said connecting rod.

2. The piston oil-cooling device in an engine according to claim 1, wherein a pair of said cooling oil injection groves are disposed proximate to said pair of axial oil grooves on the same side thrust face.

3. The piston oil-cooling device in an engine according to either one of claim 1 or claim 2, wherein when the engine is of a vertical type with said crankshaft disposed vertically, said side thrust face in which said cooling oil injection groove is provided is a lower one of side thrust faces of said larger end.

4. The piston oil-cooling device in an engine according to either one of claim 1 or claim 2, wherein a side thrust face of said crankshaft opposite said side thrust face of said larger end is configured to cover an entire open surface of said cooling oil injection groove.

5. The piston oil-cooling device in an engine according to either one of claim 1 or claim 2, wherein said larger end is comprised of a semi-cylindrical larger end body integrally formed at a rod portion and a semi-cylindrical cap coupled to the larger end body, and said pair of axial oil grooves are provided at a boundary between said larger end body and said cap.

* * * * *